United States Patent [19]

Marco

[11] 4,259,393

[45] Mar. 31, 1981

[54] FIBRILLATED POLYESTER TEXTILE FABRIC

[75] Inventor: Francis W. Marco, Pauline, S.C.

[73] Assignee: Milliken Research Corporation, Spartanburg, S.C.

[21] Appl. No.: 947,368

[22] Filed: Oct. 2, 1978

[51] Int. Cl.[3] ..... B32B 27/02

[52] U.S. Cl. ..... 428/224; 28/271; 428/225; 428/229; 428/253; 428/364; 428/365; 428/397; 428/400

[58] Field of Search ..... 428/224, 225, 229, 245, 428/253, 254, 265, 105, 107, 397, 364, 365, 400, 85, 91, 92, 93, 904; 28/271; 66/202; 139/420 R; 6/421, 426 R

[56] References Cited

U.S. PATENT DOCUMENTS

| | | | |
|---|---|---|---|
| 2,939,202 | 6/1960 | Holland | 428/224 |
| 3,109,220 | 11/1963 | McHinney et al. | 428/225 |
| 3,508,390 | 4/1970 | Bagnall et al. | 428/225 |
| 4,025,679 | 5/1977 | Denny | 428/229 |
| 4,124,924 | 11/1978 | Phillips et al. | 28/271 |
| 4,141,122 | 2/1979 | Trifunovic | 28/271 |
| 4,168,298 | 9/1979 | Fitzgerald | 28/271 |

FOREIGN PATENT DOCUMENTS

| | | | |
|---|---|---|---|
| 45-7029 | 5/1970 | Japan | 28/271 |

*Primary Examiner*—James J. Bell

*Attorney, Agent, or Firm*—H. William Petry; Terry T. Moyer

[57] ABSTRACT

A process for forming a polyester textile fabric comprised of multifilament yarns having at least about five broken and fibrillated ends per square centimeter of fabric.

12 Claims, 9 Drawing Figures

FIBRILLATED POLYESTER TEXTILE FABRIC

Wool is currently the prestige fabric for business apparel. Bank presidents wear wool while the less than rich make do with polyester. Unfortunately, for those who might wish to exaggerate their true economic status, the practiced eye can distinguish between wool and polyester at ten paces. Typically, wool has a matte appearance and grows shiny or reflective only as it becomes worn while continuous filament polyester is relatively shiny even when new. Continuous filament polyester is often delustered by titanium dioxide and texturizing but the most successful approach to giving polyester the appearance of wool has been to cut fine filaments of polyester into short lengths to form tow which is spun to form yarn. Fabric formed from spun polyester has both the matte appearance and the surface texture of wool. However, this approach has some serious drawbacks. Not only is it relatively expensive to form a fabric from the spun yarn but also it has been necessary to use heavier weight fabrics and to include natural fibers to achieve fabric aesthetics comparable to those obtained with texturized continuous filament polyester.

This invention concerns a fabric formed from continuous multifilament texturized polyester yarns which has the appearance and hand of a woolen fabric since it has a large number of broken and split filaments distributed over its area. Typically, each broken end is split into four or more fibrils whose thickness is less than half the thickness of the filament they project from, while the length of these fibrils is usually at least four times the thickness of the filament. These fibrils when viewed at large magnification give an appearance somewhat like that of a brush or an old fashioned broom. The fibrils not only deluster the surface of the fabric and simulate the surface texture of a woolen fabric, but they also greatly increase the comfort of the fabric since they are very long and flexible; thus they do not press into the skin as would a filament that was merely broken without having fibrils at the broken end. The fabric of the present invention should not be confused with fabrics typically formed by sanding since these fabrics usually have large numbers of broken filaments but the ends are not fibrillated, thus the feel is harsher and the delustering effect is somewhat lessened.

An even more desirable fabric can be formed from multilobal texturized polyester because when multilobal filaments are fibrillated, they tend to split along the creases between the lobes; thus, if there are many lobes on each filament, it is relatively easy to obtain a corresponding number of fibrils and these fibrils tend to be longer than those formed under equivalent circumstances from filaments which do not have creases.

This wool-like polyester fabric can be formed from a fabric containing texturized polyester filaments by breaking a substantial number of these filaments while treating the fabric with a highly alkaline solution. One desirable way of breaking the filaments is to repeatedly force the fabric through a relatively small orifice. The orifice should be small enough that considerable tension is required to pull the fabric through. This method is especially desirable if the fabric is forced through by the action of a fluid jet directed through the orifice. If this is done, then the fluid in the jet can be highly alkaline so the filaments may be broken and fibrillated in a one-step process. If a jet orifice is not used, it seems to be advantageous to agitate the highly alkaline fluid while it is in contact with the fabric and the filaments are being broken.

The pH of the fluid should be at least about 9.5 and preferably between 10 and 13.5. The best results for a commercial operation is obtained when the pH is between 11 and 12. In an aqueous solution, this pH may be obtained by using an alkalai metal hydroxide such as sodium hydroxide. However, better fibrillation is achieved more economically if a quaternary ammonium salt is used in addition. Extremely elevated temperatures are not required and in fact good results can be obtained at temperatures between about 30° and 70° C., while better results are obtained between about 40° and 60° C. and the best results are obtained between about 45° and 65° C. Temperatures higher than 70° C. can be used, but it is wasteful.

The process can easily be carried out in a commercial jet dyeing machine provided that a suitably small orifice is available. Alternatively, the orifice may be roughened slightly to break more filaments. However, since high temperatures are not required, it is not necessary to utilize an expensive high pressure jet dyeing machine, if a low pressure equivalent is available or can be fabricated.

This method of forming a wool-like polyester fabric should not be confused with the so called denier reduction methods which use alkaline solutions to reduce the size of filaments to form fabrics which are typically characterized as "silky" and which do not contain a substantial number of broken filaments. The fabrics formed by this invention are easily distinguished from sanded fabrics which have many unfibrillated broken ends.

DETAILED DESCRIPTION OF THE INVENTION

Figure 1:
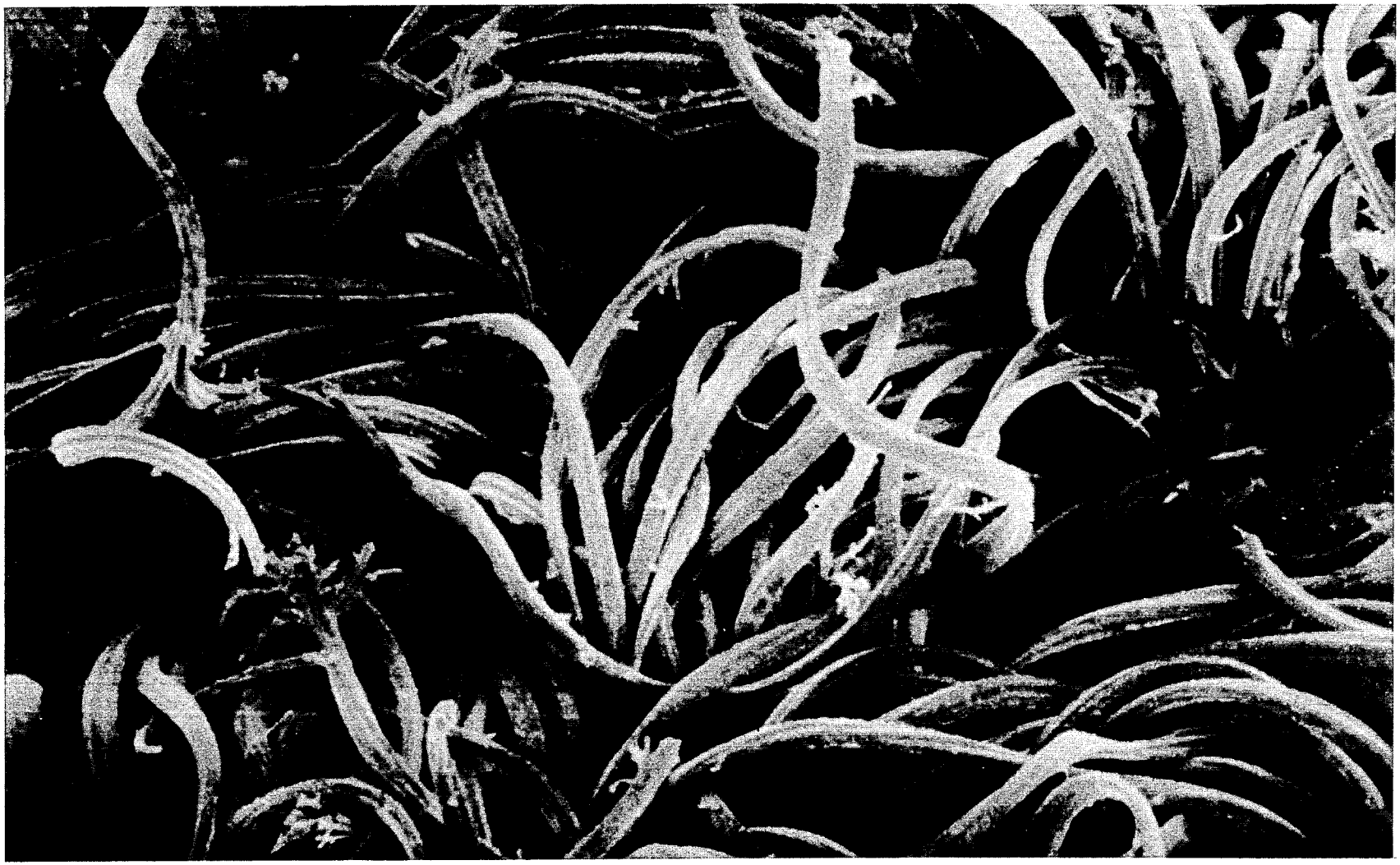
FIGS. 1 through 7 are electron micrographs of fabrics having fibrillated broken filaments.

Using this invention, it is possible to fibrillate fabrics containing texturized polyester filaments. While filaments having any cross-section will fibrillate, it is easier to fibrillate multilobal filaments. It is thought that the creases between lobes present weak points which are convenient sites for attack by the alkaline solution and it appears that the multilobal filaments split lengthwise along the crease lines. Thus, when a filament having a large number of lobes is fibrillated, many fibrils are typically formed at each broken end and it appears that these are about half the thickness of the filament they project from. Better comfort and opacity are obtained in fabrics that contain at least about 15 filaments per sq. cm. which are broken and fibrillated where each broken end has at least about 2 and preferably 4 fibrils per end and the fibrils have an aspect ratio of at least about 8. The best results are obtained when between about 50 and about 1000 filaments per sq. cm. are broken and of these between about 25% and 75% are fibrillated. Each fibrillated broken end should ideally have at least about 4 fibrils projecting from it; the aspect ratio of these should be at least about 8 and their thickness should be between 0.05 and 5 microns.

These fabrics are obtained by breaking a suitable number of filaments while exposing filaments to the action of an alkaline polyester degrading agent. The filaments can be broken by any suitable method which breaks filaments without breaking all of the filaments in a yarn. Those methods include abrasion, repeated flexing, needle punching, exposure to a fluid jet, squeezing, and beating. Exposure to a fluid jet and abrasion are the preferred methods. The most convenient method seems to be simultaneous abrasion and exposure to a fluid jet. This effect is easily obtained in a device similar to the orifice of a jet dyeing machine. A jet dyeing machine may be used but this is somewhat wasteful since a jet dyeing machine is very expensive because it is built to withstand high pressures which are not necessary for the fibrillation process. Perhaps the best equipment for fibrillating polyester would be essentially similar to a jet dyeing machine but would be constructed for lower pressures. Many other kinds of equipment can be used for breaking filaments and treating the fabric with highly alkaline solution. Typical examples of these include dolly washers, jet rope washers, fulling mills, and scutchers. The degree and type of fibrillation produced depend upon the alkalinity and temperature of the fluid as well as the type of abrasion.

Good fibrillation is obtained when the fabric is abraded while it is contacted with a highly alkaline solution having a pH of between about 10 and 13.5 at a temperature of between about 30° and 70° C. Better fibrillation is obtained when the pH is between about 11.0 and 12.0 and the temperature is between about 40° and 60° C. The best results are obtained when the pH is between about 11.3 and 11.6 and the temperature is between 45° and 55° C.

The following examples are provided only to illustrate specific embodiments of the invention while the limits of the invention are delineated in the claims.

EXAMPLE I

Figure 2:
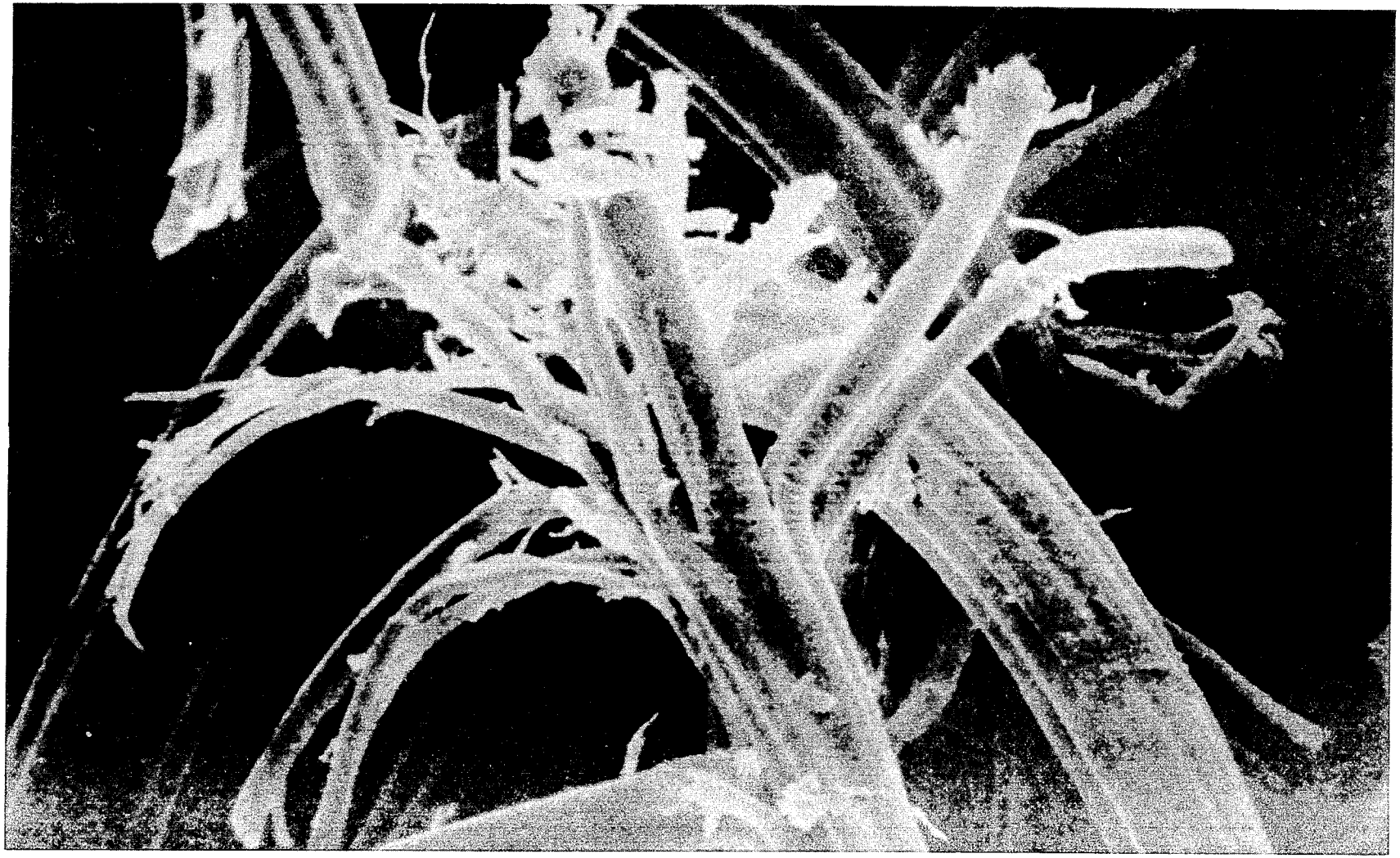

A sample of woven false twist texturized polyester was placed in a Mathis JF laboratory jet dyeing apparatus having a 30 millimeter orifice. The jet machine is filled with an aqueous solution of 0.3% sodium hydroxide and 0.022% of di "coco" dimethyl ammonium chloride at 40° C. The machine was run for 150 minutes at maximum agitation; the fabric was rinsed and soured with acetic acid. Upon inspection, it was found that the fabric had lost 4.6% of its weight. FIGS. 1 and 2 are electron micrographs which illustrate broken ends of the type which characterize the fabric of this invention. It should be noted that several fibrils project from the broken end and that the thickness of each fibril is less than half of the thickness of the filament they project from. Further, it should be noted that the length of many of the fibrils is more than four times the thickness of the filament.

EXAMPLE II

Figure 3:
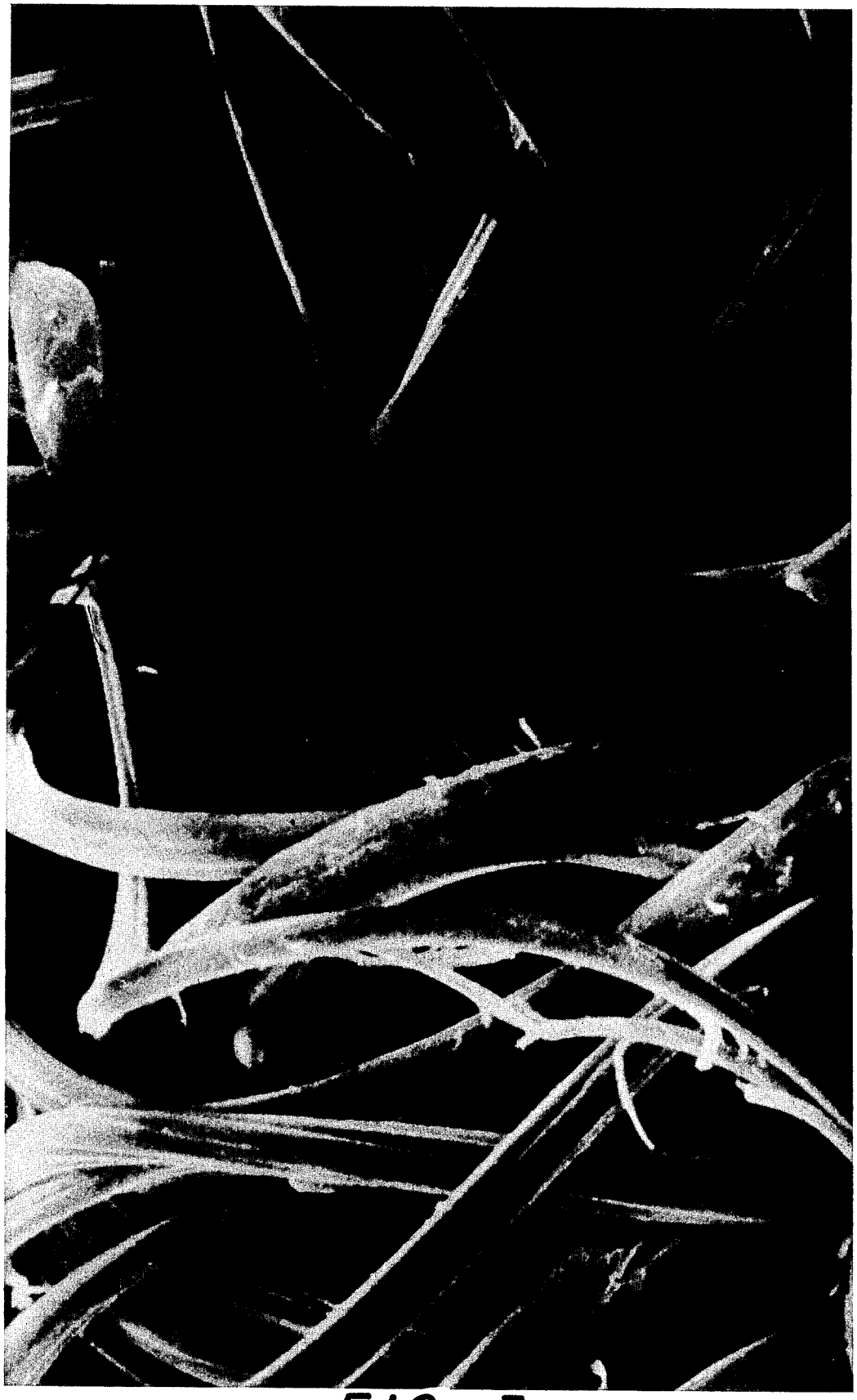

The procedure of Example I was repeated using an aqueous solution containing 0.33% sodium hydroxide and 0.016% n-"tallow" pentamethyl propane diammonium dichloride at 55° F. The apparatus was run for an hour. Upon inspection, it was found that many filaments had broken and fibrillated and that the fabric had lost 1.5% of its weight. FIG. 3 is an electron micrograph of a portion of the resulting fabric.

EXAMPLE III

Figure 4:
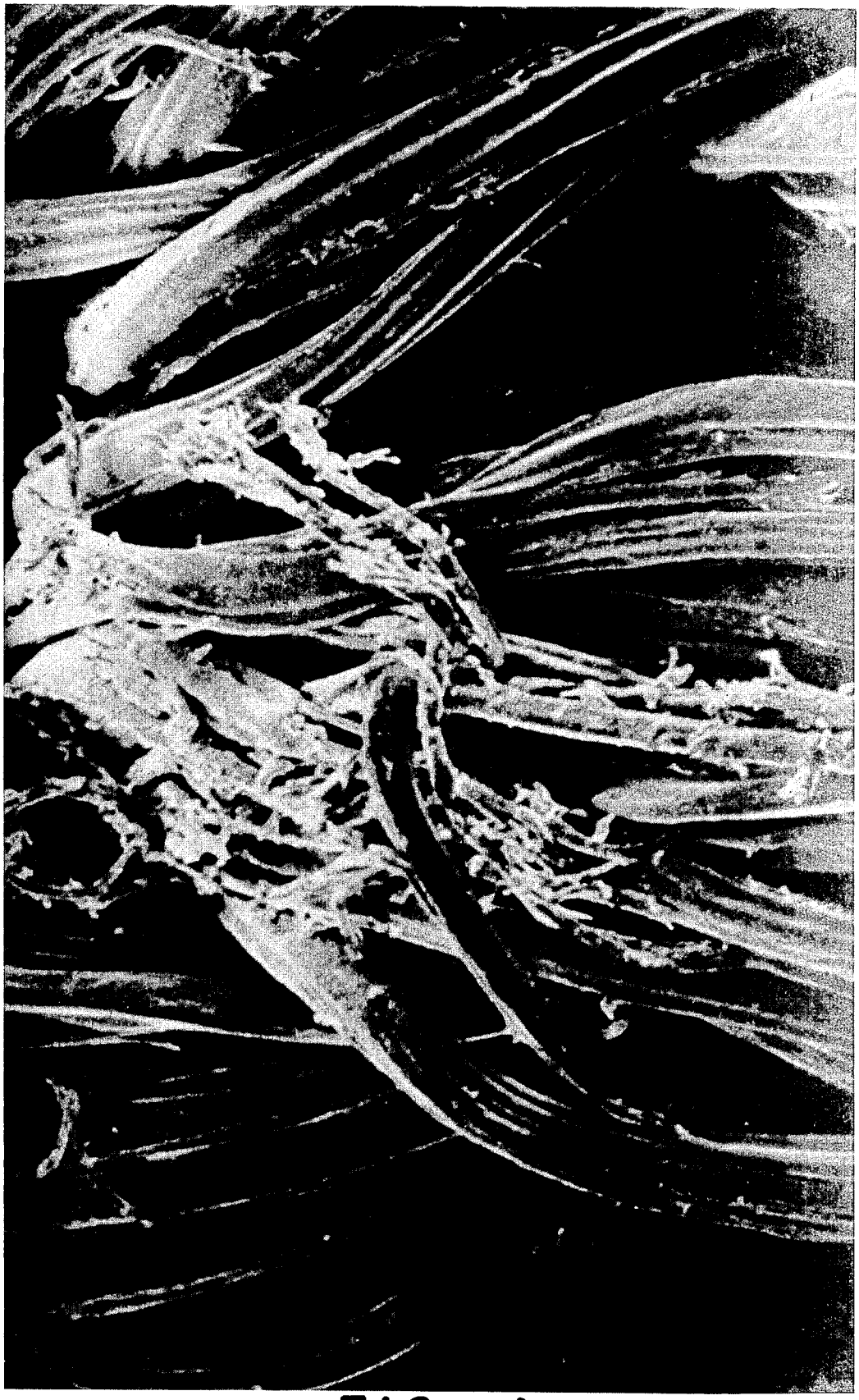

A sample of 100% false twist texturized double knit polyester fabric was placed in a dolly washer which was filled with an aqueous solution of 1.5% sodium hydroxide and 0.11% di "coco" dimethyl ammonium chloride at 49° C. For a period of three hours, the wet fabric was continuously drawn out of the solution, passed through rubber squeeze rolls and reimmersed in the solution. During this time, the solution was allowed to gradually cool to 38° C. The fabric was recovered, rinsed and soured. FIG. 4 is an electron micrograph of the resulting fabric.

Figure 5:
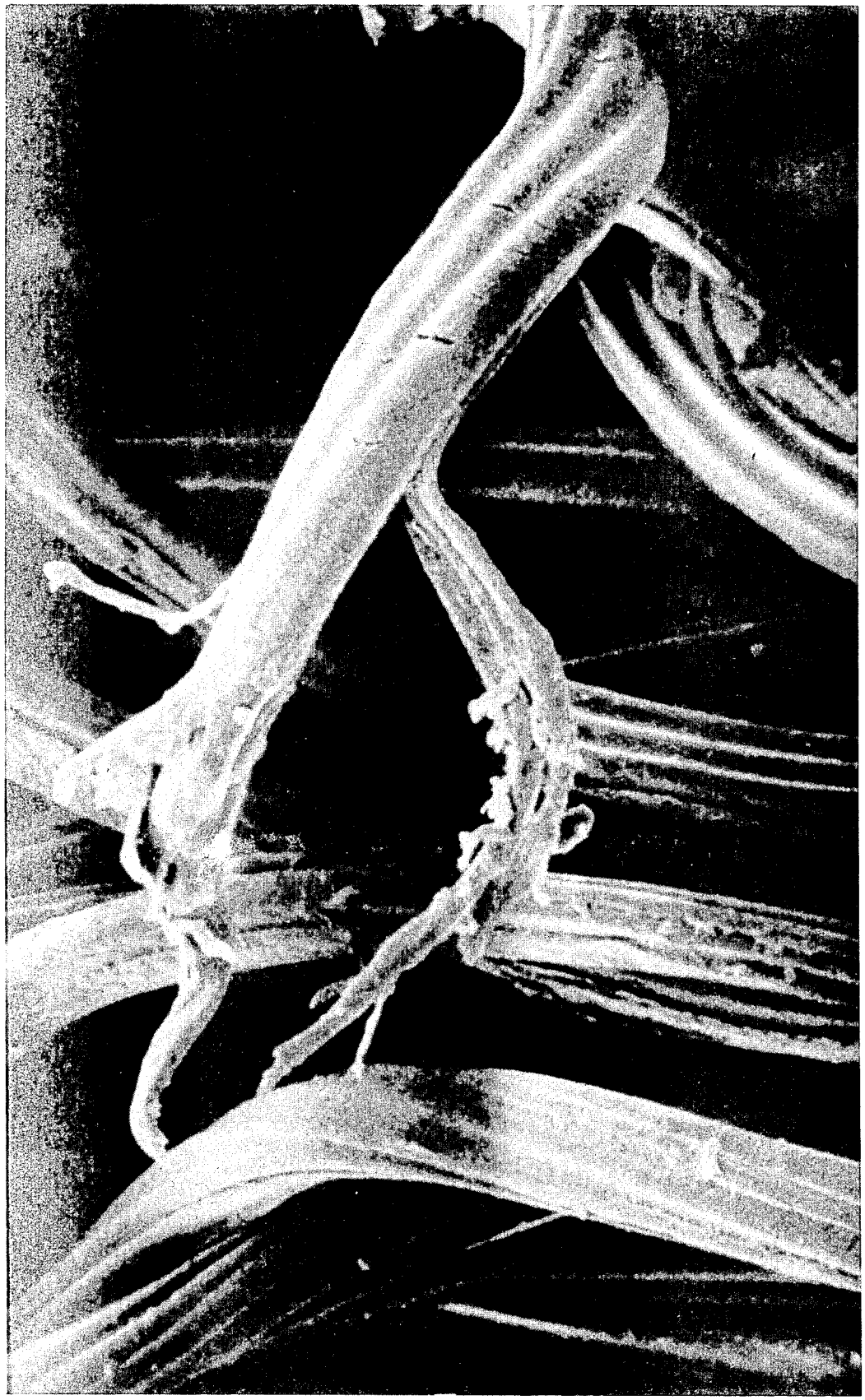

EXAMPLE IV 300 yards of 100% false twist texturized double knit polyester fabric was placed in a single tube Gaston County Jet Dyeing Machine which was filled with an aqueous solution of 1.5% sodium hydroxide and 0.11% of di "coco" dimethyl ammonium chloride at 60° C. The fabric was run at 320 yards per minute for two hours, then rinsed, soured, dyed, dried and heat set. Upon inspection the fabric had a pleasant hand much like that of wool. FIG. 5is an electron micrograph of a portion of the fabric.

EXAMPLE V

Figure 6:
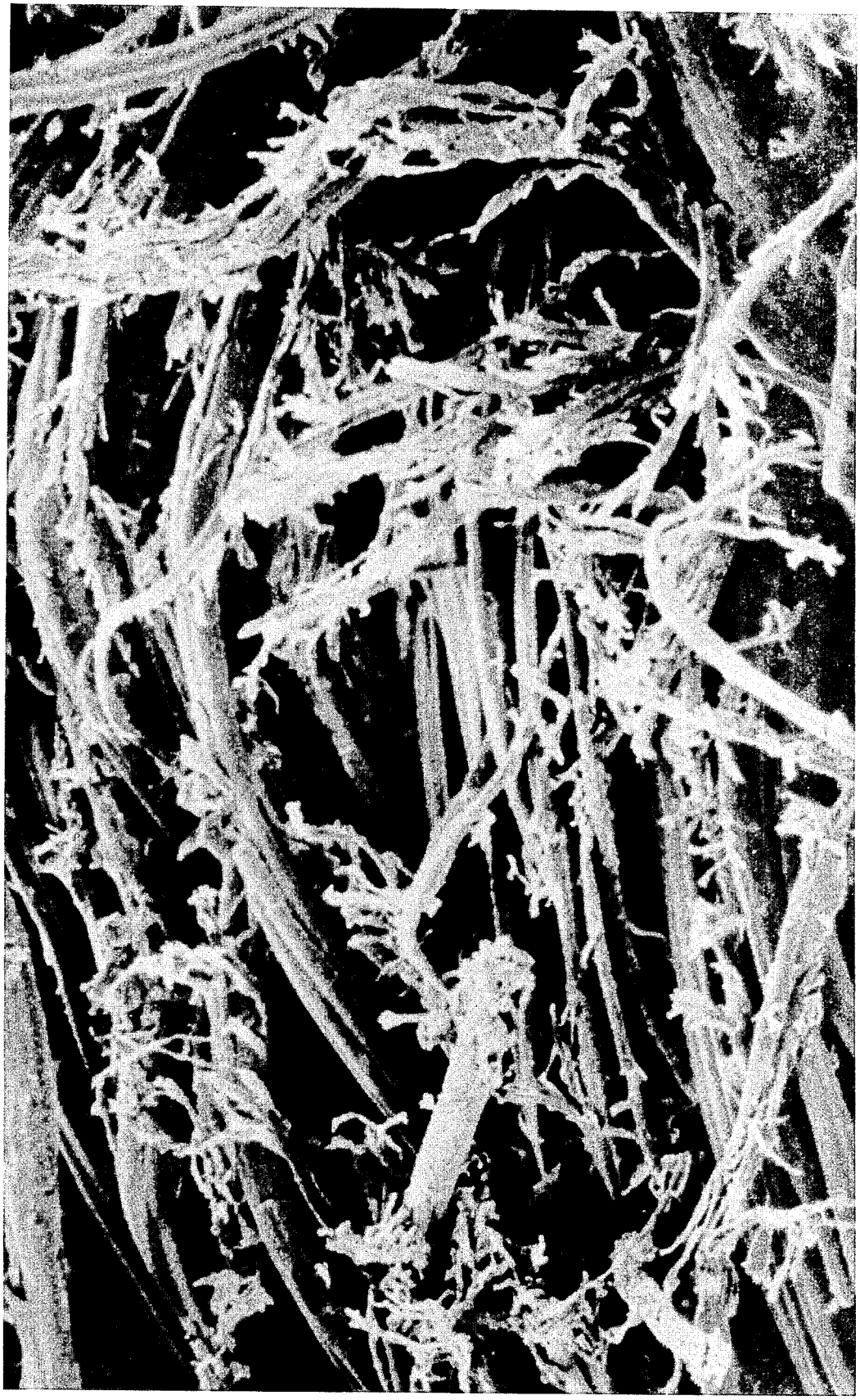
Figure 7:
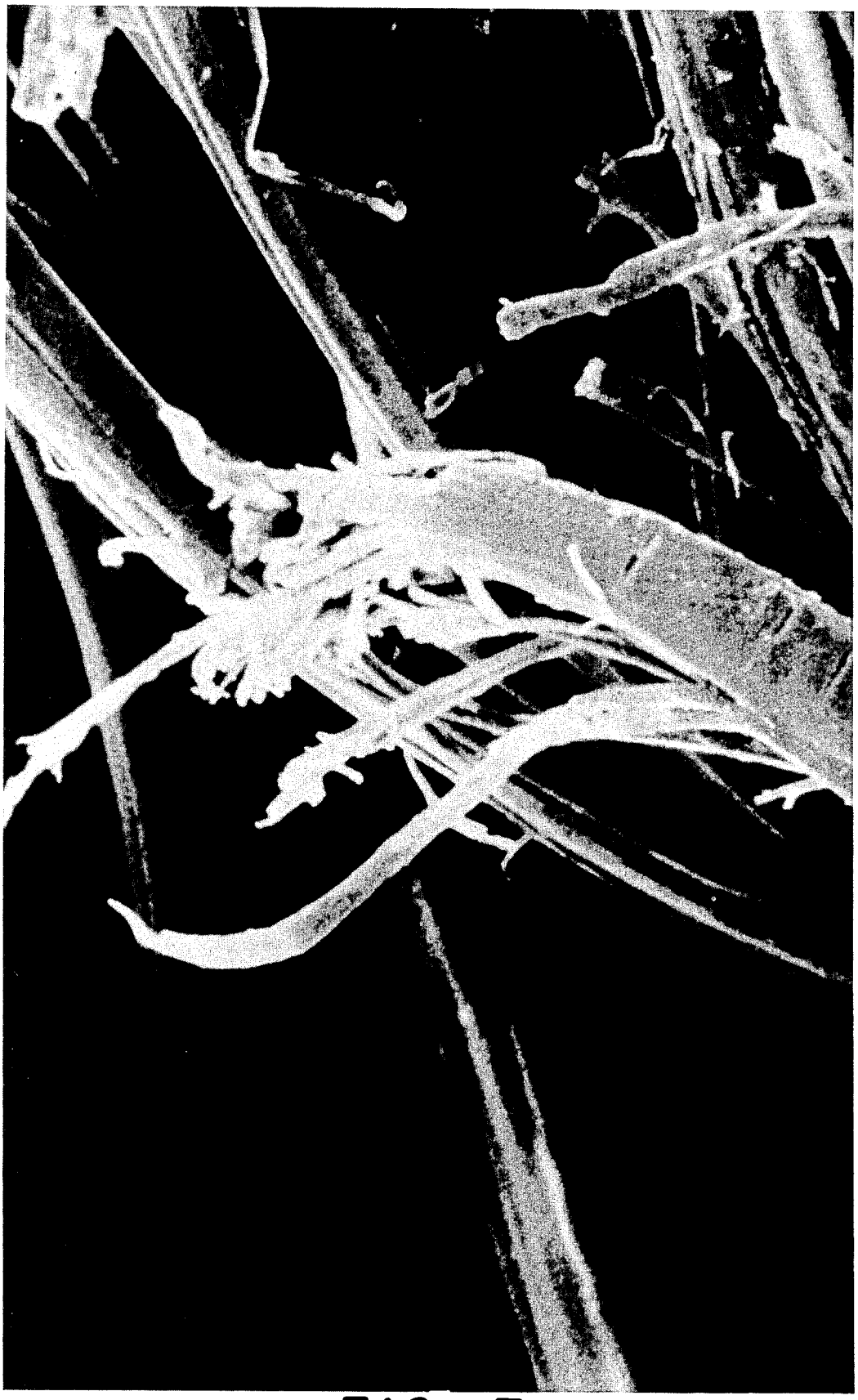

A sample of 100% texturized polyester woven fabric was immersed in a solution of 0.4% sodium hydroxide and 0.03% di "coco" dimethyl ammonium chloride at 56° C. While immersed, the fabric was rubbed against a polymethyl methacrylate abrasive surface for 18 minutes at a frequency of 100 times per minute. The fabric was recovered, rinsed and soured. FIGS. 6 and 7 are photomicrographs of the abraded portion of the fabric.

EXAMPLE VI

A sample of 100% texturized woven polyester fabric was placed in a laboratory fulling mill which was filled with 0.3% sodium hydroxide and 0.025% di "coco" dimethyl ammonium chloride at 30° C. After being run for 45 minutes, the fabric was found to have many filaments which were broken and fibrillated at the broken ends.

EXAMPLE VII

The procudure of Example I was repeated using as aqueous solution of 10% sodium hydroxide at 55° C. After being run for an hour, the fabric was rinsed and soured. Many filaments in the fabric were broken and fibrillated.

EXAMPLE VIII

Figure 8:
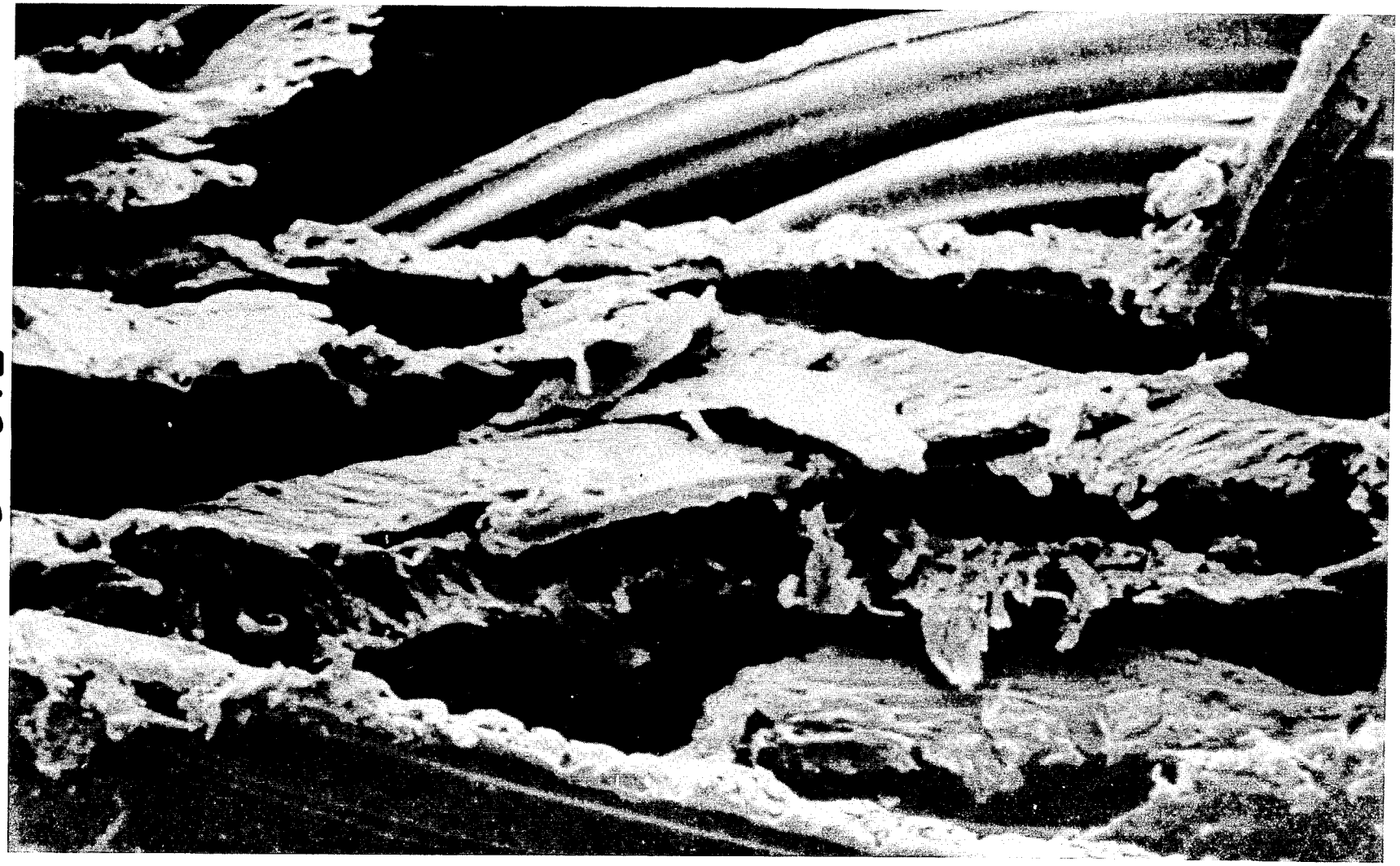
FIG. 8 is an electron micrograph of a fabric which has been sanded and then treated with a solution of caustic and a quaternary ammonium salt.

A sample of 100% texturized polyester woven fabric was sanded and then treated under low agitation in a rotating basket in a Mathis Laboratory Dyeing Machine, Type JF. The machine was filled with an aqueous solution containing 0.5% sodium hydroxide and 0.5% di "coco" dimethyl ammonium chloride at 55° C. After being run for an hour, the fabric was found to have many ends which were broken but these ends were not fibrillated. FIG. 8 is a photomicrograph of a portion of this fabric.

EXAMPLE IX

Figure 9:
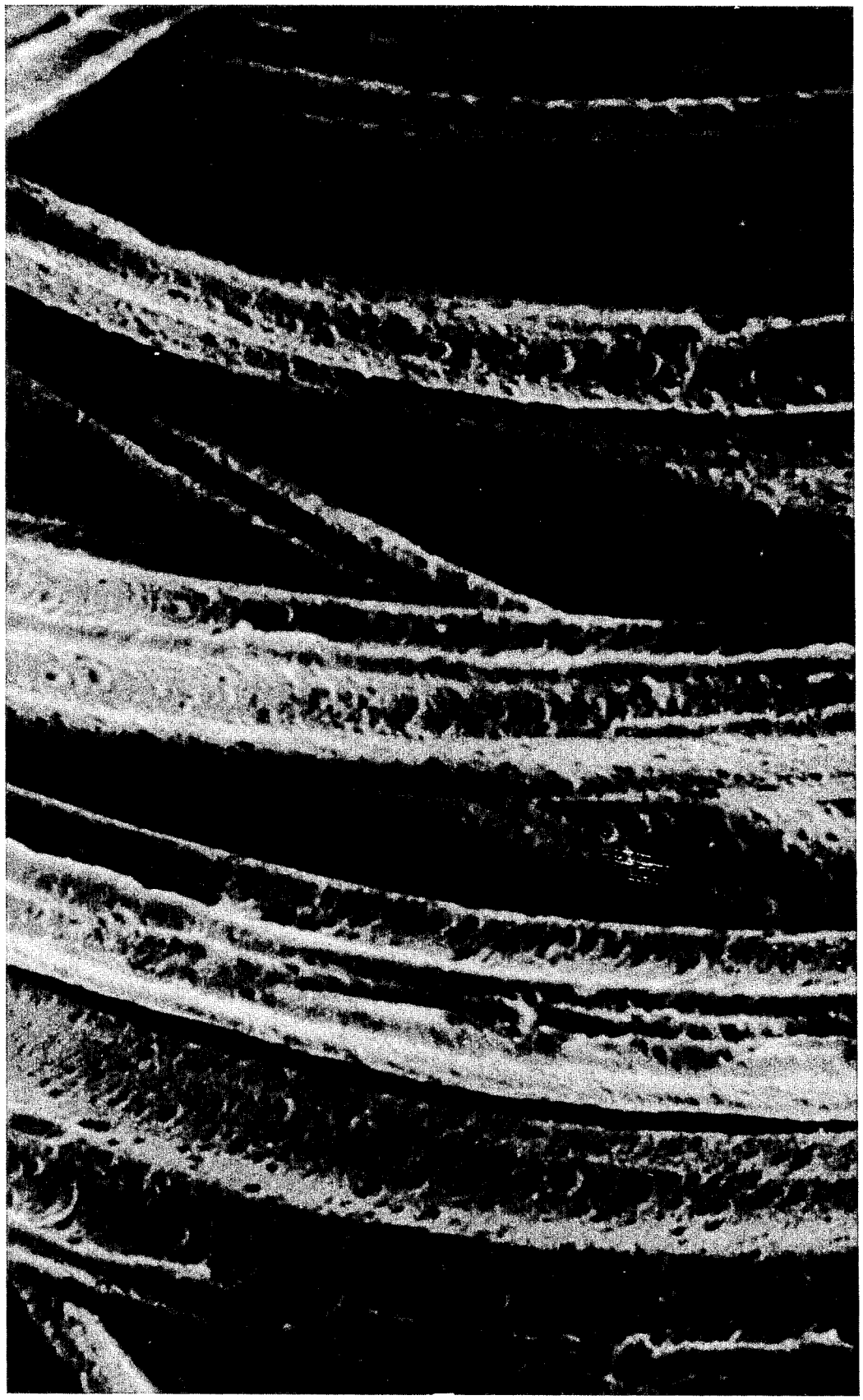
FIG. 9 is an electron micrograph of a fabric which has been subjected to a typical denier reduction process.

A sample of 100% texturized woven polyester fabric was placed in a rotating basket in a Mathis Laboratory Dyeing Machine, Type JF. The machine was filled with an aqueous solution containing 2½% sodium hydroxide. After being treated for 20 minutes at 130° C., the fabric was found to have lost 35% of its weight but there were no fibrillated broken ends. FIG. 9 is an electron micrograph of a portion of the fabric.

As my invention, I claim:

1. A textile fabric comprised of a plurality of yarns, each said yarn comprising a multiplicity of texturized polyester filaments characterized in that on an average at least about 5 of said texturized polyester filaments per square centimeter of fabric are broken and the ends of said broken filaments have a plurality of fibrils projecting from them, the thickness of each said fibril being no more than half of the thickness of the filament they project from and the length of each said fibril being over 4 times the thickness of the filament.

2. A textile fabric according to claim 1 wherein at least 15 filaments are broken per square centimeter of fabric.

3. A textile product according to claim 2 wherein at least four fibrils project from each said broken end.

4. A textile product according to claim 1 wherein at least four fibrils project from each said broken end.

5. A textile product according to claim 4 wherein the length of each said fibril is at least about 4 times the thickness of the filament it projects from and the thickness of each said fibril is less than about half the thickness of the filament it projects from.

6. A textile product according to claim 1 wherein the length of each said fibril is at least about 4 times the thickness of the filament it projects from and the thickness of each said fibril is less than about half the thickness of the filament it projects from.

7. A textile product according to claim 1 wherein at least 50 filaments are broken per square centimeter of fabric.

8. A textile product according to claim 7 wherein at least four fibrils project from said broken end.

9. A textile product according to claim 8 wherein the length of each said fibril is at least about 4 times the thickness of the filament it projects from and the thickness of each said fibril is less than about half the thickness of the filament it projects from.

10. A textile product according to claim 7 wherein the length of each said fibril is at least about 4 times the thickness of the filament it projects from and the thickness of each said fibril is less than about half the thickness of the filament it projects from.

11. A textile product according to claim 10 wherein said polyester filaments are false twist textured multilobal.

12. A textile product according to claim 1 wherein said polyester filaments are false twist textured multilobal.

* * * * *

UNITED STATES PATENT OFFICE

CERTIFICATE OF CORRECTION

Patent No. 4,259,393 Dated March 31, 1981

Inventor(s) Francis W. Marco

It is certified that error appears in the above-identified patent and that said Letters Patent are hereby corrected as shown below:

Column 3, line 43, change "is" to --was--.

Column 4, line 24, change "5is" to --5 is--.

Column 4, line 46, change "procudure" to --procedure--.

Column 4, line 46, change "as" to --an--.

Column 4, line 59, change "0.5%" to --0.05%--.

Column 6, line 12, after "from" insert --each--.

Signed and Sealed this

*Fifteenth* Day of *June 1982*

[SEAL]

*Attest:*

GERALD J. MOSSINGHOFF

*Attesting Officer* *Commissioner of Patents and Trademarks*